United States Patent [19]

Chastine

[11] Patent Number: 4,490,992

[45] Date of Patent: Jan. 1, 1985

[54] HOUSEHOLD REFRIGERATOR COMPRESSOR VIBRATION ISOLATOR AND CONDENSATE COLLECTING TRAY

[75] Inventor: Gary L. Chastine, Lousiville, Ky.

[73] Assignee: General Electric Company, Louisville, Ky.

[21] Appl. No.: 566,789

[22] Filed: Dec. 29, 1983

[51] Int. Cl.[3] ..... F25D 19/00

[52] U.S. Cl. ..... 62/295; 248/606; 248/632; 312/100; 62/448

[58] Field of Search ..... 62/568, 448, 295; 312/100; 248/606, 632

[56] References Cited

U.S. PATENT DOCUMENTS

| | | | |
|---|---|---|---|
| 2,536,811 | 1/1951 | Horlacher | 62/295 |
| 2,635,939 | 4/1953 | Obenchain | 312/100 |
| 2,639,208 | 5/1953 | Obenchain | 312/100 |
| 2,685,178 | 8/1954 | Eck | 62/115 |
| 2,792,231 | 5/1957 | Compton | 280/5 |
| 2,935,279 | 5/1960 | La Porte et al. | 248/632 |
| 2,985,310 | 5/1961 | Norris | 211/74 |
| 3,040,899 | 6/1962 | Kron | 210/364 |
| 3,191,897 | 6/1965 | Comerer | 248/606 |
| 3,399,553 | 9/1968 | Lehto | 70/158 |
| 3,727,421 | 4/1973 | Berg | 62/295 |
| 3,819,244 | 6/1974 | Paulick et al. | 312/101 |

*Primary Examiner*—Lloyd L. King

*Attorney, Agent, or Firm*—Frank P. Giacalone; Radford M. Reams

[57] ABSTRACT

A high-side portion of a refrigeration system is supported on a condensate collecting tray formed in a single piece of molded plastic which includes in combination a condensate water overflow containment area and a drop-in rotary compressor mounting arrangement wherein the compressor is resiliently supported in the overflow containment area with its axis in a vertical position in a manner which provides torsional and vertical vibration isolation, the containment area being dimensioned so that only an overflow of condensate water will come in contact with the compressor.

16 Claims, 12 Drawing Figures

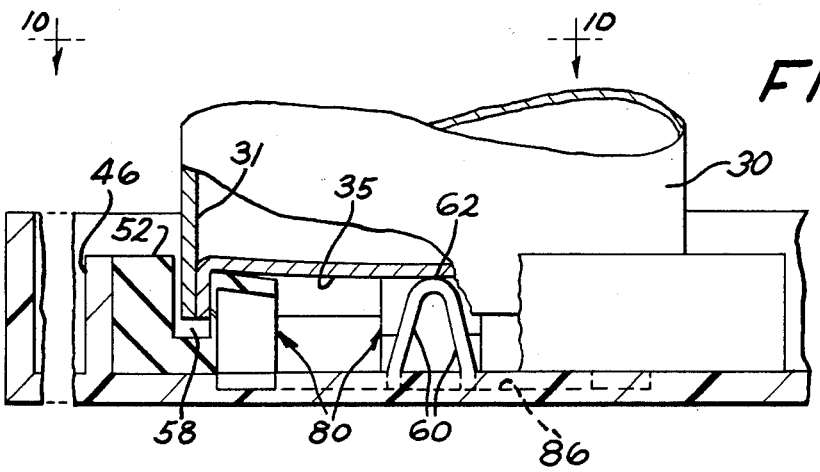
FIG. 9
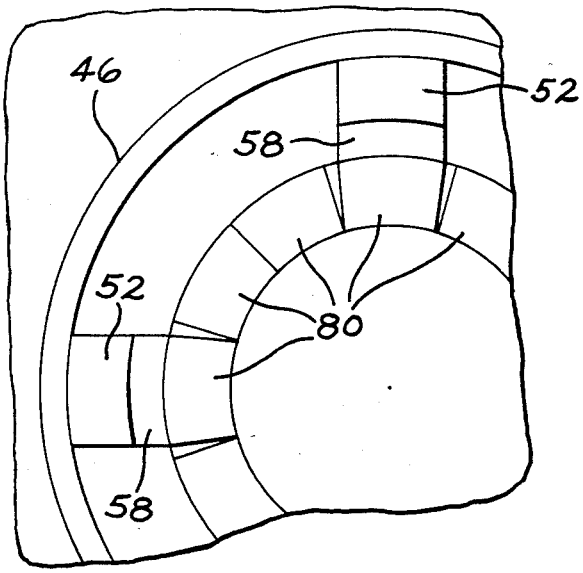
FIG. 10
FIG. 11
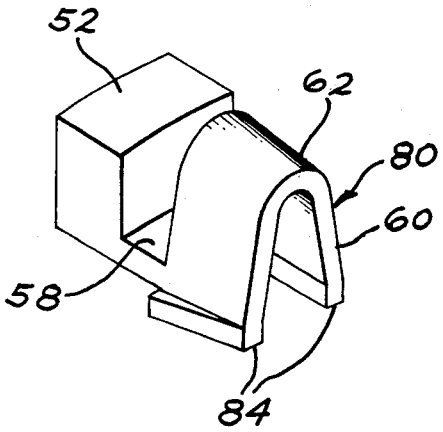
FIG. 12
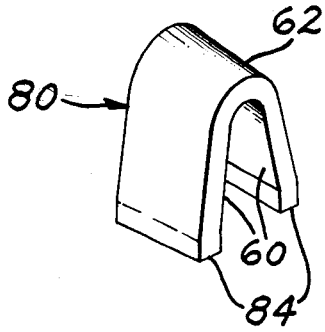

HOUSEHOLD REFRIGERATOR COMPRESSOR VIBRATION ISOLATOR AND CONDENSATE COLLECTING TRAY

BACKGROUND OF THE INVENTION

By the present invention a rotary compressor vibration isolation means is provided which affords both torsional and vertical vibration isolation of the compressor in combination with a condensate collecting tray made in a single piece of molded plastic which includes a condensate overflow containment area in which the compressor is resiliently mounted in its upright position.

It has been common practice to support the motor compressor on a series of circumferentially spaced posts including resilient means interposed between the base on which the compressor is located and supporting legs secured to the motor compressor casing. The supports are usually secured to the compressor casing such as by welding. This procedure may result in a slight deformation of the compressor casing. Since the compressor casing is customarily sized to securely hold the compressor and motor, any distortion of casing dimensions can result in compressor misalignment relative to the casing. Accordingly, the compressor casing must be measured and resized to insure a proper vertical alignment of the motor and rotary compressor relative to the casing. Further, the presence of supporting legs projecting from the compressor casing would interfere with some automotive assembly operations.

SUMMARY OF THE INVENTION

Accordingly, it is an object of the present invention to provide a drop-in resilient compressor mounting arrangement adapted to receive the compressor. By the present invention, a rotary motor compressor vibration isolator is provided which provides both torsional and vertical vibration isolation which allows a simple drop-in installation of the compressor. A household refrigeration apparatus is provided having means forming a compartment to be refrigerated and means forming an equipment compartment for housing a unitary removable refrigerating apparatus forming the high side portion of a refrigeration system including a compressor having a side wall connected by bottom and top walls and a compressor support member arranged in said equipment compartment having a bottom wall, means mounting the compressor on said bottom wall of the support member comprising an upwardly extending disposed wall on the bottom wall which defines a compressor support containment area. A resilient compressor support member is provided which is dimensioned to be received in the compressor support containment area of the support member. The resilient compressor support member includes an outer wall portion arranged between the compressor side wall and the wall defining the compressor support containment area for locating the compressor in the upright position in the containment area. The support member includes an inner support area on which the compressor bottom wall rests in spaced relationship relative to the bottom wall of the support member and which carries the main weight of the compressor. The inner support area of the support member is formed with a plurality of adjacent wall portions diverging downwardly from an upper apex portion wherein the upper apex portions of adjacent wall portions engage the bottom wall of the compressor with the lower edge portion of adjacent wall portions engaging the bottom wall of the support member to provide both torsional damping and axial damping of the compressor.

BRIEF DESCRIPTION OF THE DRAWINGS

FIG. 9 is a veiw similar to FIG. 4 showing another embodiment of the compressor mounting arrangement;

FIG. 10 is a fragmentary plan view showing certain details of the embodiment of FIG. 9; and FIGS. 11 and 12 are enlarged perspective views of the mounting components of the embodiment shown in FIG. 9.

DESCRIPTION OF THE PREFERRED EMBODIMENT

Figure 1:
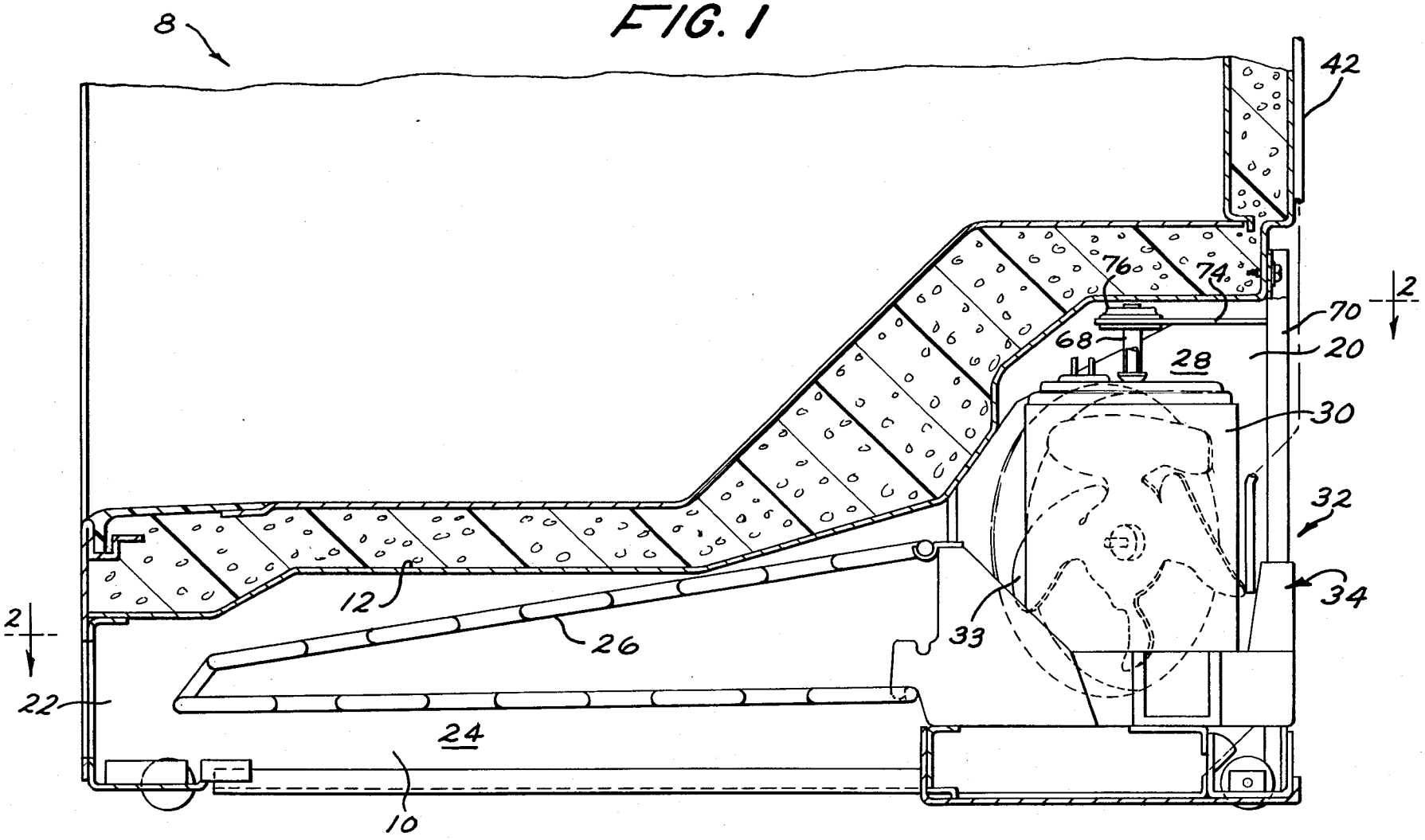
FIG. 1 is a vertical sectional view of a portion of a refrigerator showing the machinery compartment and unitary high-side refrigerator components including the compressor mounting arrangement of the present invention.

Referring now to the accompanying drawings, there is shown a portion of a household refrigerator cabinet 8 including a machinery compartment 10 in the lower portion of the cabinet. The compartment 10 is separated from the refrigerated portion of the cabinet by an insulated wall 12, and is further defined by side walls 16 and 18 of the cabinet and a rear wall having an opening 20, and has an air inlet opening 22 at the front thereof. Generally, the machinery compartment 10 has a low profile forward section 24 at the front portion thereof for receiving a condenser 26 and a higher profile rear section 28 at the rear portion dimensioned for accommodating the rotary motor compressor unit 30 with its axis in the vertical position.

Figure 2:
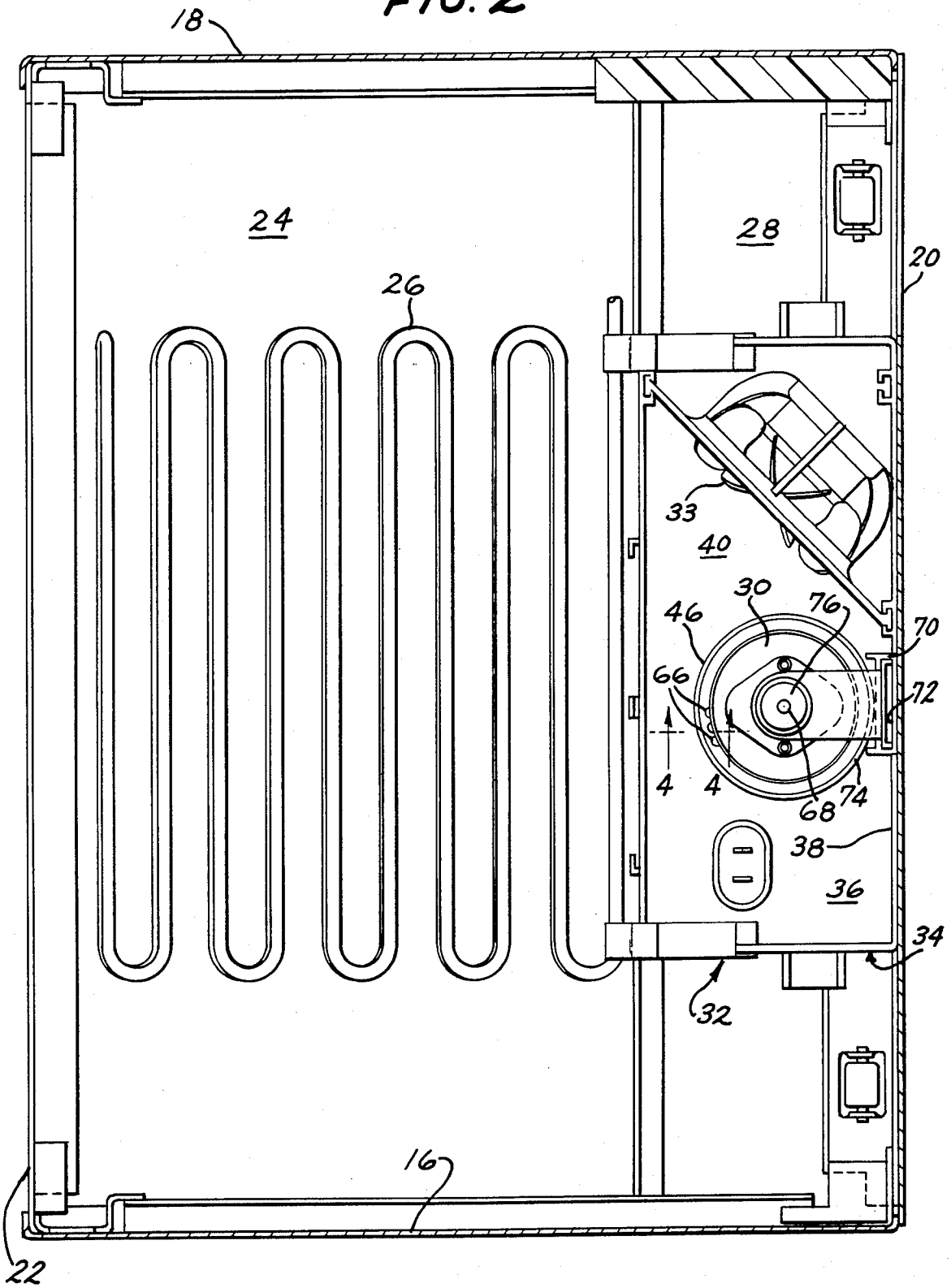
FIG. 2 is a sectional plan view taken along line 2—2 of FIG. 1.

In the present embodiment shown a unitary assembly 32, generally including the high-side components of the refrigeration system and air circulating fan 33, is adapted to be arranged in the machinery compartment 10 through opening 20 as shown in FIGS. 1 and 2. The unitary assembly 32 consists generally of a formed platic base pan or support member 34. The support member 34 includes a bottom wall 36 and an upwardly extending peripheral wall 38 which defines a condensate collection area 40. The support member 34 is located in compartment 10 so that the collection area 40 will receive drain water from a drain tub 42 extending from an evaporator drain (not shown) in the refrigerated portion of the cabinet. As part of the water disposal system, an overflow water containment area 44 (FIG. 3) is formed on wall 36 by an upwardly extending impervious wall 46 in the area 40. The upper edge of wall 46 is located at an elevation somewhat below the upper edge of peripheral wall 38 so the overflow water will enter containment area 44 when the level of water in collection area 40 rises above the height of wall 46. The compressor 30 is mounted relative to the bottom wall 36 so that its bottom wall 35 is arranged in containment area 44. Under certain adverse conditions, such as high humidity conditions, water may collect in area 40 at a rate which exceeds the ability of the air flow through compartment 10 to evaporate it. Accordingly, excess water flowing into area 44 will come in direct contact with a portion of the relatively hot operating compressor. Thus heated, the water evaporates much faster than that remaining in area 40.

Figure 3:
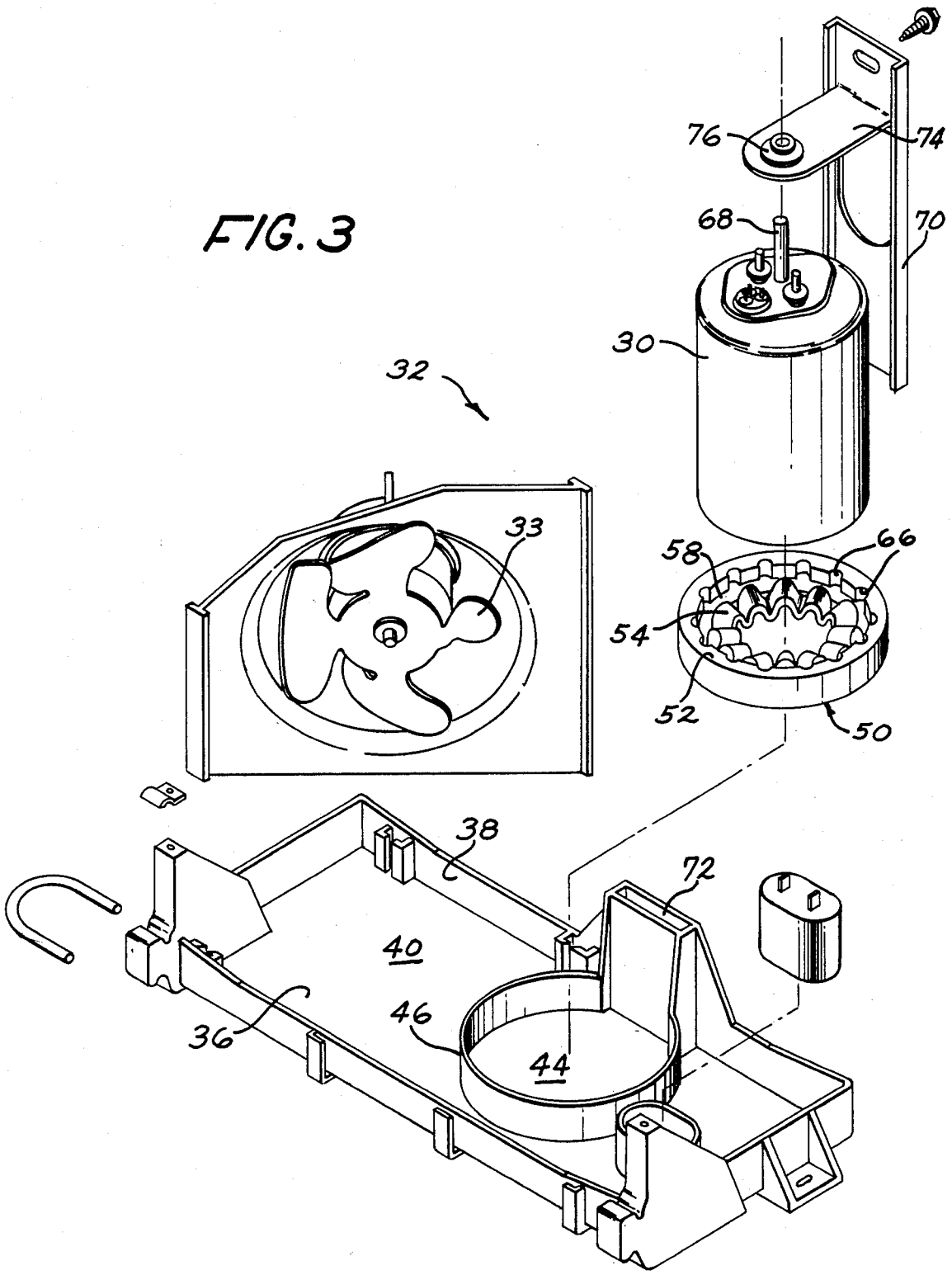
FIG. 3 is an exploded perspective showing the high-side components prior to their assembly.

By the present invention, means are provided for resiliently supporting the rotary motor compressor unit 30 vertically in the containment area 44. To this end, a resilient ring-shaped member 50 (FIG. 3 is dimensioned to fit into the containment area 44. The resilient member 50 includes an outer ring portion 52 which is dimensioned to receive the motor compressor casing therewithin, and an inner ring portion 54 on which the lower wall of the compressor casing 35 is supported. In the embodiment shown, the outer ring 52 is dimensioned radially to substantially fill the area between the compressor outer wall and the wall 46 to provide resilient support or resistance to transverse movement of the compressor relative to its axis. Further, the provision of resilient members 50 having outer ring portions 52 of varying radial dimensions permits the employment of compressors of varying diameters. This arrangement allows the use of one base member 34 of single design to be used in combination with different capacity or sized compressors.

The compressor employed in carrying out the present invention includes an outer casing wall 31 and an inverted cup-shaped bottom wall 35. As viewed in FIGS. 4–8, the bottom wall 35 is in fact recessed relative to the lower annular edge portion of the outer casing wall 31 which results in an annular depending wall portion or lip 56. In order to accommodate the depending wall portion 56 which in fact serves to position the compressor centrally relative to the resilient member 50, there is provided an annular recess or receiving area 58 located radially between the inner portion 54 and outer portion 52 of ring 50.

Figure 4:
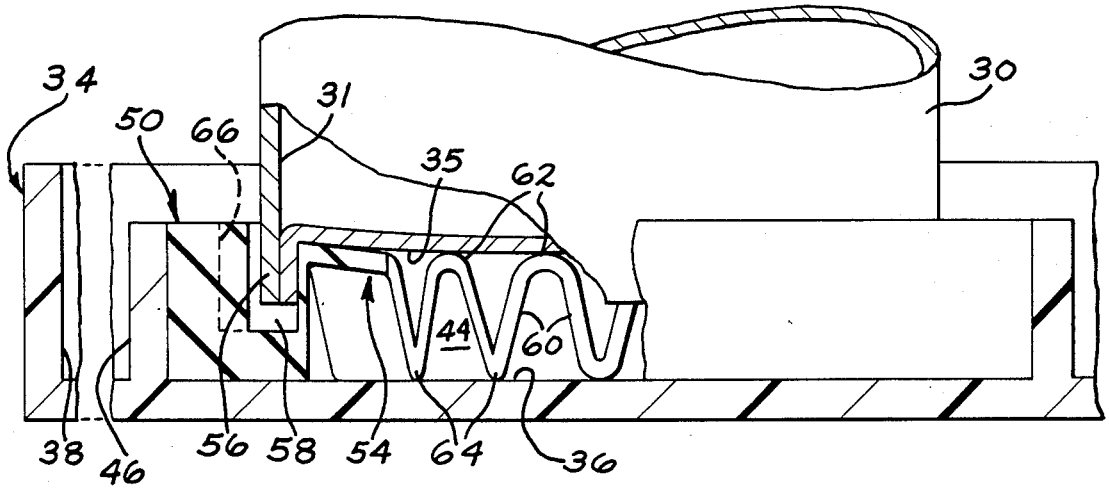
FIG. 4 is a vertical sectional view taken along line 4—4 of FIG. 2 showing the compressor mounting arrangement.
Figure 5:
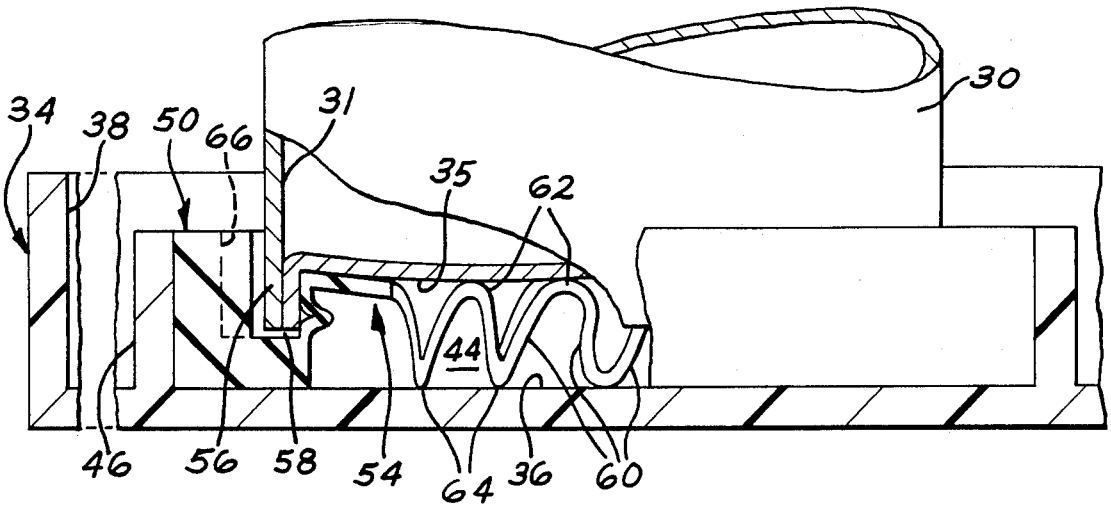
FIG. 5 is a view similar to FIG. 4 showing the movement between compressor mounting components.

The inner ring 54 which carries the main weight of the compressor is formed with a convoluted circumferentially disposed wall portions 60 which carries the main weight of the compressor. As best shown in FIGS. 4 and 5, the upper apex portion 62 of adjacent convolutions engage the bottom wall 35 of the compressor casing while the lower apex portion 64 of the adjacent convolutions engage the bottom wall 36 of support member 34. This arrangement provides both torsional damping and axial damping of the compressor while supporting the compressor in spaced relationship relative to the bottom wall 36 of member 34. The convoluted wall portions 60 are in effect trapped between the compressor bottom wall 35 and bottom wall 36 of support member 34 so that, as shown in FIG. 5, compressor vibration causes vertical compression of the convoluted wall portions 60 thereby providing axial damping, while torsional vibration of movement of the compressor causes rotary distortion of the convoluted wall portions 60 to provide torsional damping.

Figure 6:
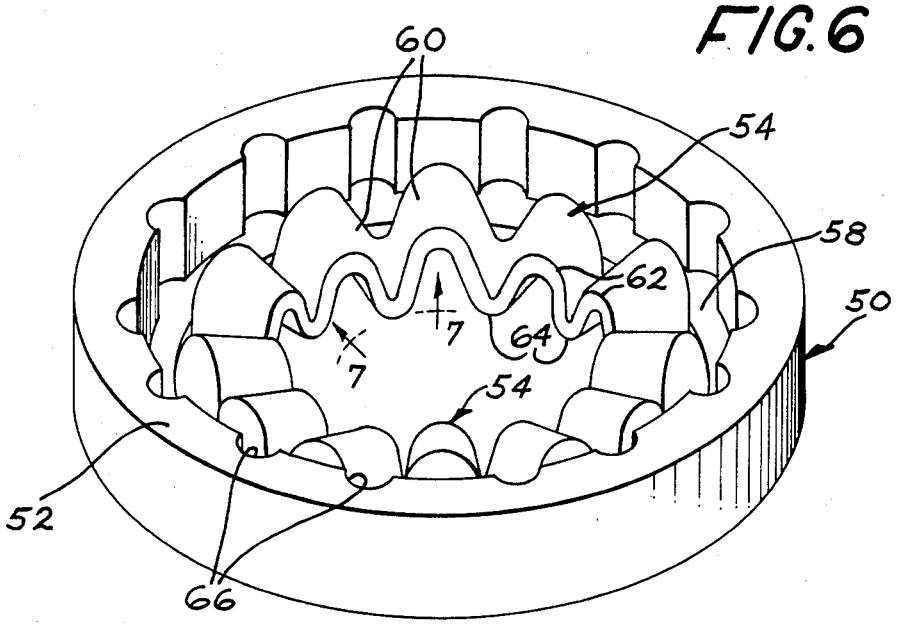
FIG. 6 is an enlarged perspective showing details of the compressor mounting ring.
Figure 7:
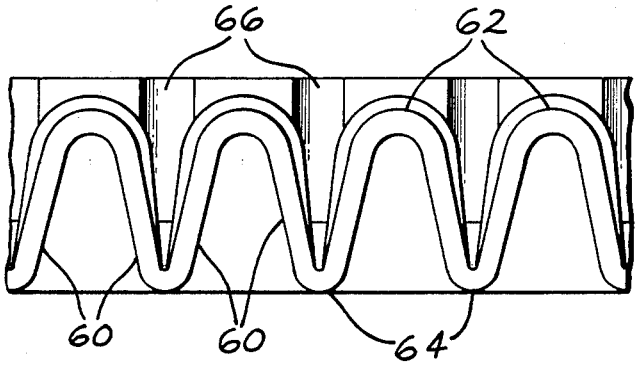
FIG. 7 is a fragmentary elevational view taken along line 7—7 of FIG. 6 folded out to show certain details.
Figure 8:
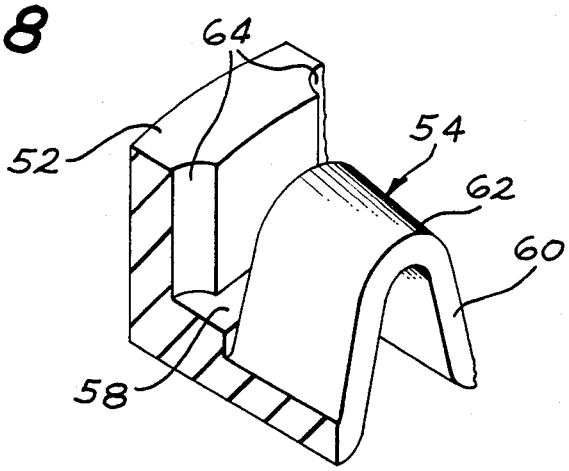
FIG. 8 is an enlarged perpective showing one section of the compressor mounting ring.

The outer ring 52 is dimensioned to substantially fill the area between the compressor outer side wall and the wall 46 forming containment area 44 to provide resilient support or resistance to transverse movement of the compressor relative to its axis. Further, providing resilient members wherein radial dimension of the outer ring may vary, allows the accommodation of different size compressors. The outer ring 52 is shown and described as a continuous circumferentially disposed portion which engages the continuous wall 46. It should be noted that with regard to its function of resiliently restricting transverse movement of the compressor the righ 50 may be of a different configuration. The outer portion 52 could, for example, be a plurality of spaced radially projecting portions which would contact the wall 46 at spaced intervals. Further, in the event the overflow evaporation system were not employed, the continuous wall 46 may be separated with a plurality of circumferentially spaced wall portions, each adapted to engage the spaced radially projecting portions. To facilitate the flow of water between the areas 40 and 44 the outer ring 52 when it is in fact dimensioned to substantially fill the area between the compressor outer wall and the wall 46, there is is formed a plurality of circumferentially spaced passageways 66 which are arranged adjacent the side wall of the compressor. The passageways 66 are so located, as seen in FIGS. 6–8, so as to direct overflow water from area 40 to flow in the area between the upper apex portions 62 and thence into area 44. The exact number of convolutions, the thickness of the walls 60, and the flexibility of the material used in fabricating the resilient member 50 is dependent on several parameters including the weight, physical size and motor size of the compressor. One skilled in the art may, after determining the parameters set out above, readily determine the dimensions and characteristics required of the member 50.

During normal operation, the above-described compressor mounting arrangement maintains the compressor in its vertical operating position. However, under certain conditions such as during shipment or moving of the refrigerator from one location to another the compressor may become dislodged from its position in the resilient ring. Accordingly, as best shown in FIGS. 2 and 3, the compressor is supported at its upper end to insure the vertical stability of the compressor axis. To this end, the compressor is provided with a stud 68 which is secured to and extends upwardly centrally from the upper wall of the compressor casing and secured thereto. A support structure is provided including a post 70 which is adapted to be slidably supported vertically in a slot 72 formed in the rear portion of wall 38. The post 70 includes a support arm 74 extending perpendicular thereto to a position where it overlies the compressor. Located on the arm 74 is a resilient grommet 76 which receives the stud 68. With the compressor 30 located on the resilient member 50 as described above, the post 70 is inserted in slot 72 and lowered until the stud 68 is located in grommet 76 to thereby stabilize the vertical axis of the compressor.

Referring now to FIGS. 9–12, there is shown another embodiment of the resilient compressor support system wherein similar parts are designated by the same reference characters used in the above described embodiment. Generally, the common characteristics of the resilient member 50 is the provision of wall portions 60 that diverge from an upper apex portion 62. Generally, substantially all of the movement of the wall portion 60 caused by the compressor 30 is generated about the upper apex 62 with the lower edge of the wall portions remaining substantially stationary relative to the wall 36.

To this end, the resilient ring 50 may be modified as indicated in FIG. 10 to include a plurality of inverted U-shaped members designated 80. Each of the members 80 includes an upper apex 62 and wall portions 60 diverging therefrom The U-shaped members 80 are spaced circumferentially with the upper apex 60 in engagement with the bottom wall 35 of the compressor in the same manner as described above in conjunction with ring 50. As mentioned above, contact between the wall 46 and compressor 30 may be affected at spaced intervals. To this end, a selected number of the U-shaped members 80 may be provided with outer portions 52 which serve to center and provide restrictive transverse movement of the compressor. The exact number of outer portions 52 to be provided would depend on the parameters stated above. Accordingly, a recess 58 is formed between the inner U-shaped wall portions 60 and the outer portions 52. The outer portion 52 serves to act as a bumper between the compressor and wall 46. In this instance with the members 80 being separate and arranged circumferentially, and the outer portion 52 may be present only on selected ones of the members 80, as for example three or four circumferentially spaced bumpers may be appropriate. The lower edge portions 84 of the U-shaped members may be located in a recess 86 formed in the wall 36 which serves to radially locate the members 80 relative to the bottom wall 35 of the compressor. Resistive movement of the walls 60 in the embodiment are similar to the walls 60 of the continuous convoluted embodiment for both axial and torsional damping of the compressor generated vibrations. Also, in some installations it may be necessary to provide a continuous circumferential wall portion such as in the previously described embodiment, while in other installations, spacing approximately six or twelve members may suffice to provide the resistive damping required.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A resilient support for mounting a compressor on a support member comprising:

means mounting said compressor on the bottom wall of said support member comprising:

upwardly extending wall portions on said bottom wall defining a compressor support containment area;

a resilient compressor support member dimensioned to be received in said compressor support containment area of said support member;

said resilient compressor support member includes an outer wall portion arranged between said compressor side wall and said wall portions defining said compressor support containment area for centering said compressor in the upright position in said containment area; and an inner support area on which said compressor bottom wall rests in spaced relationship relative to said bottom wall of said support member and which carries the main weight of said compressor;

said inner support area being formed with a plurality of adjacent wall portions diverging downwardly from an upper apex portion providing spaced circumferential wall portions wherein the upper apex portions of adjacent wall portions engage the bottom wall of said compressor and the lower edge portions of said adjacent wall portions engage the bottom wall of said support member whereby movement of said compressor relative to said adjacent wall portions causes a resistance to movement of said apex portion relative to said lower edge portion to provide both torsional damping and axial damping of said compressor.

2. The resilient support recited in claim 1 wherein said inner support area is formed with a continuous convoluted circumferential wall portion with the upper apex portion of adjacent convolutions engaging the bottom wall of said compressor and the lower apex portions of adjacent convolutions engaging the bottom wall of said support member.

3. The resilient support recited in claim 1 further including a central stud member extending upwardly from said top wall of said compressor, an arm member extending upwardly from said support member including a horizontally extending member positioned over said top wall of said compressor, resilient means on said horizontally extending member dimensioned to receive said central stud member for resiliently supporting said compressor in a vertical position.

4. The resilient support recited in claim 3 wherein said upwardly extending wall portion defining said compressor support containment area is a circumferentially disposed impervious wall which extends upwardly to a position below said peripheral wall of said support member so as to allow overflow condensate from said condensate collection area to flow into said compressor support containment area and into contact with said compressor to be evaporated by heat generated by operating components of said compressor.

5. The resilient support recited in claim 4 wherein circumferentially spaced grooves are formed on said upwardly peripheral wall portion of said resilient member to provide passageways adjacent said compressor side wall which permit overflow condensate to flow into the lower portion of said containment area between said bottom wall of said support member and said bottom wall of said compressor.

6. The resilient support recited in claim 1 wherein said inner support area is formed with a plurality of adjacent inverted U-shaped members providing spaced circumferential wall portions wherein the upper apex portion of adjacent inverted U-shaped members engage the bottom wall of said compressor and the lower edge portion of said wall portions of adjacent U-shaped wall portions engage the bottom wall of said support member.

7. The resilient support recited in claim 6 further including a central stud member extending upwardly from said top wall of said compressor, an arm member extending upwardly from said support member including a horizontally extending member positioned over said top wall of said compressor, resilient means on said horizontally extending member dimensioned to receive said central stud member for resiliently supporting said compressor in a vertical position.

8. The resilient support recited in claim 7 wherein said upwardly extending wall portion defining said compressor support containment area is a circumferentially disposed impervious wall which extends upwardly to a position below said peripheral wall of said support member so as to allow overflow condensate from said condensate collection area to flow into said compressor support containment area and into contact with said compressor to be evaporated by heat generated by operating components of said compressor.

9. In a refrigeration apparatus having means forming a compartment to be refrigerated and means forming an equipment compartment for housing a refrigerating apparatus forming the high-side portion of a refrigeration system including a compressor having a side wall connected by bottom and top walls and a compressor support member arranged in said equipment compartment having a bottom wall;

means mounting said compressor on said bottom wall of said support member comprising:

upwardly extending wall portions on said bottom wall defining a compressor support containment area;

a resilient compressor support member dimensioned to be received in said compressor support containment area of said support member;

said resilient compressor support member includes an outer wall portion arranged between said compressor side wall and said wall portions defining said compressor support containment area for centering said compressor in the upright position in said containment area; and an inner support area on which said compressor bottom wall rests in spaced relationship relative to said bottom wall of said support member and which carries the main weight of said compressor;

said inner support area being formed with a plurality of adjacent wall portions diverging downwardly from an upper apex portion providing spaced circumferential wall portions wherein the upper apex portions of adjacent wall portions engage the bottom wall of said compressor and the lower edge portions of said adjacent wall portions engage the bottom wall of said support member whereby movement of said compressor relative to said adjacent wall portions causes a resistance to movement of said apex portion relative to said lower edge portion to provide both torsional damping and axial damping of said compressor.

10. The refrigerating apparatus recited in claim 9 wherein said inner support area is formed with a continuous convoluted circumferential wall portion with the upper apex portion of adjacent convolutions engaging the bottom wall of said compressor and the lower apex portions of adjacent convolutions engaging the bottom wall of said support member.

11. The refrigeration apparatus recited in claim 9 further including a central stud member extending upwardly from said top wall of said compressor, an arm member extending upwardly from said support member including a horizontally extending member positioned over said top wall of said compressor, resilient means on said horizontally extending member dimensioned to receive said central stud member for resiliently supporting said compressor in a vertical position.

12. The refrigeration apparatus recited in claim 11 wherein said upwardly extending wall portion defining said compressor support containment area is a circumferentially disposed impervious wall which extends upwardly to a position below said peripheral wall of said support member so as to allow overflow condensate from said condensate collection area to flow into said compressor support containment area and into contact with said compressor to be evaporated by heat generated by operating components of said compressor.

13. The refrigeration apparatus recited in claim 12 wherein circumferentially spaced grooves are formed on said upwardly peripheral wall portion of said resilient member to provide passageways adjacent said compressor side wall which permit overflow condensate to flow into the lower portion of said containment area between said bottom wall of said support member and said bottom wall of said compressor.

14. The refrigeration apparatus recited in claim 9 wherein said inner support area is formed with a plurality of adjacent inverted U-shaped members providing spaced circumferential wall portions wherein the upper apex portion of adjacent inverted U-shaped members engage the bottom wall of said compressor and the lower edge portion of said wall portions of adjacent U-shaped wall portions engage the bottom wall of said support member.

15. The refrigeration apparatus recited in claim 14 further including a central stud member extending upwardly from said top wall of said compressor, an arm member extending upwardly from said support member including a horizontally extending member positioned over said top wall of said compressor, resilient means on said horizontally extending member dimensioned to receive said central stud member for resiliently supporting said compressor in a vertical position.

16. The refrigeration apparatus recited in claim 15 wherein said upwardly extending wall portion defining said compressor support containment area is a circumferentially disposed impervious wall which extends upwardly to a position below said peripheral wall of said support member so as to allow overflow condensate from said condensate collection area to flow into said compressor support containment area and into contact with said compressor to be evaporated by heat generated by operating components of said compressor.

* * * * *